United States Patent [19]

LeRow, Jr. et al.

[11] 4,016,384

[45] Apr. 5, 1977

[54] OPERATING MECHANISM AND POSITION INDICATOR FOR A CIRCUIT INTERRUPTER

[75] Inventors: Charles E. LeRow, Jr., Jeannette; Ronald W. Crookston, Trafford, both of Pa.

[73] Assignee: Westinghouse Electric Corporation, Pittsburgh, Pa.

[22] Filed: Nov. 19, 1974

[21] Appl. No.: 525,124

[52] U.S. Cl. ..... 200/148 R; 200/82 B; 200/308

[51] Int. Cl.[2] ..... H01H 33/00; H01H 9/00

[58] Field of Search ..... 200/148 R, 82 B, 308–317; 335/17; 116/124 L, 124 B, 132

[56] References Cited

UNITED STATES PATENTS

| | | | |
|---|---|---|---|
| 3,225,170 | 12/1965 | Chabala et al. | 200/308 |
| 3,590,189 | 6/1971 | Fischer et al. | 200/82 B X |
| 3,639,713 | 2/1972 | Fischer et al. | 200/82 B X |
| 3,852,556 | 12/1974 | Kane et al. | 200/310 |

*Primary Examiner*—James R. Scott
*Attorney, Agent, or Firm*—W. R. Crout

[57] ABSTRACT

An improved circuit-breaker position-indicator is provided for a gas-type circuit-interrupter in which the circuit-breaker structure is enclosed within an outer pressurized casing at a different pressure than the gas pressure interiorly of the circuit-breaker itself. Improved means are provided for effecting manual movement of the circuit-breaker contacts by a hand-jack assembly, when desired. Visible safe indication of the correct circuit-breaker open and closed-circuit positions is obtained at all times for safe and dependable operation of the circuit-breaker.

12 Claims, 18 Drawing Figures

CLOSED POSITION

OPERATING MECHANISM AND POSITION INDICATOR FOR A CIRCUIT INTERRUPTER

CROSS-REFERENCE TO RELATED APPLICATIONS

U.S. Pat. application filed Nov. 11, 1974, Ser. No. 522,960, by Ronald W. Crookston, Thomas E. Alverson and Otto H. Soles illustrates the general type of circuit-breaker equipment involved in the instant patent application. Additionally, reference may be made to U.S. Pat. application filed Nov. 27, 1974, Ser. No. 527,929, by Otto H. Soles et al for the general configuration of the overall circuit-breaker structure Also, see U.S. patent applications Le Row et al. filed Nov. 27, 1974 Ser. No. 527,930 and Kane et al. filed Nov. 27, 1974 Ser. No. 527,931.

BRIEF SUMMARY OF THE INVENTION

In accordance with the present invention, there is provided a generally rod-shaped movable position-indicator member mechanically connected to and movable with the movable-contact structure at high-potential. The rod-shaped contact position-indicator extends to an area, or environment, at ground potential, where accurate indication of the circuit-breaker open and closed-circuit positions is visually obtained with reliance.

The gas may be removed from either the environment surrounding the circuit-breaker structure, or interiorly of the circuit-breaker itself, without affecting the functioning of the position-indicator rod. Moreover, the indicator-rod assembly may be removed, and a manually-operable hand-jack assembly may be secured into place, as substitution therefoe, to effect manual opening and closing movements of the movable contact structure of the circuit-breaker when desired.

DESCRIPTION OF THE PREFERRED EMBODIMENT

Figure 2:
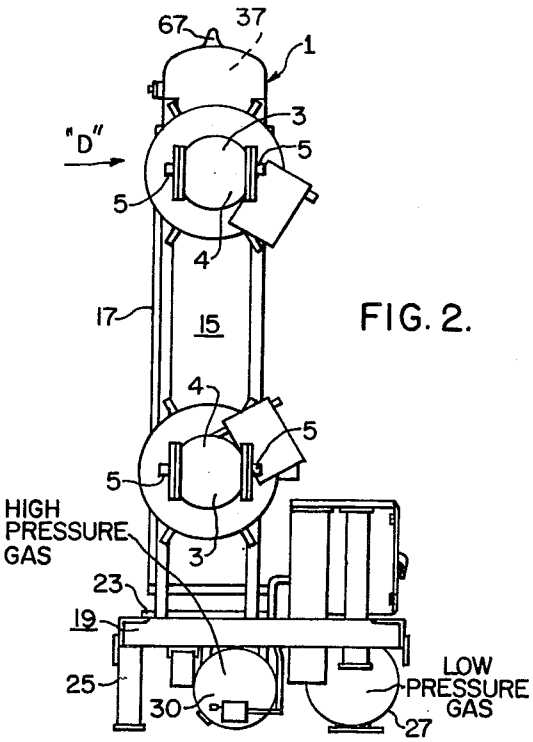
FIG. 2 is an end elevational view of the three phase circuit-breaker structure of FIG. 1.
Figure 3:
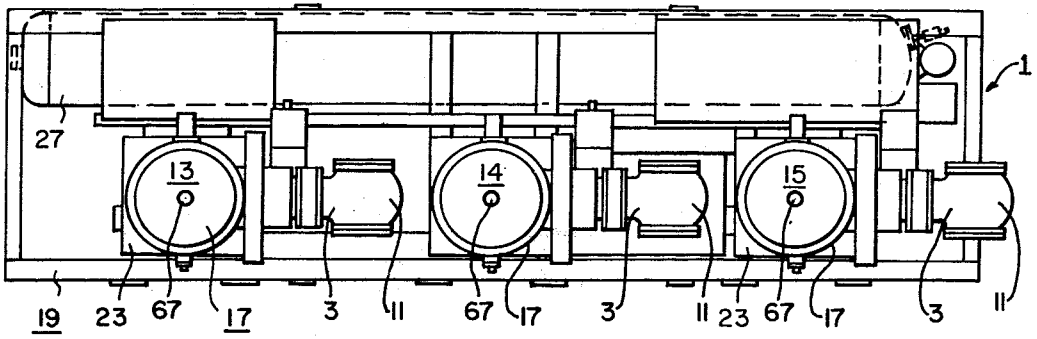
FIG. 3 is a top plan view looking downwardly upon the three circuit-breakers of FIGS. 1 and 2, indicating again the enclosed construction thereof.

Generally, the equipment 1 includes a plurality of bus assemblies 3 determined by the length that can generaly be shipped. The typical bus length 3 will be for example, 40 feet, and may cionsist of two 20-feet lengths, with an epoxy spacer (not shown) in each length. The ends of the bus 3 can be connected to additional lengths of bus 3, or any functional member of the system 1 at junction points 4. Expansion joints are located in each 20-foot bus-section 3 to absorb the maximum of 0.4 inches of expansion expected. Sulfur-hexafluoride ($SF_6$) gas 20 at 45 p.s.i.g. for example, fills both the sheath 11 and the bus condctor 3, and is free to move throughout the entire bus 3. The 45 p.s.i.g. $SF_6$ gas pressure provides approximately the highest dielectric strength possible down to −40° C. without liquefaction, eliminating the need for auxiliary heat. High-pressure $SF_6$ gas 20 (region A), however, does not require a heat input at low ambient temeratures.

Figure 1:
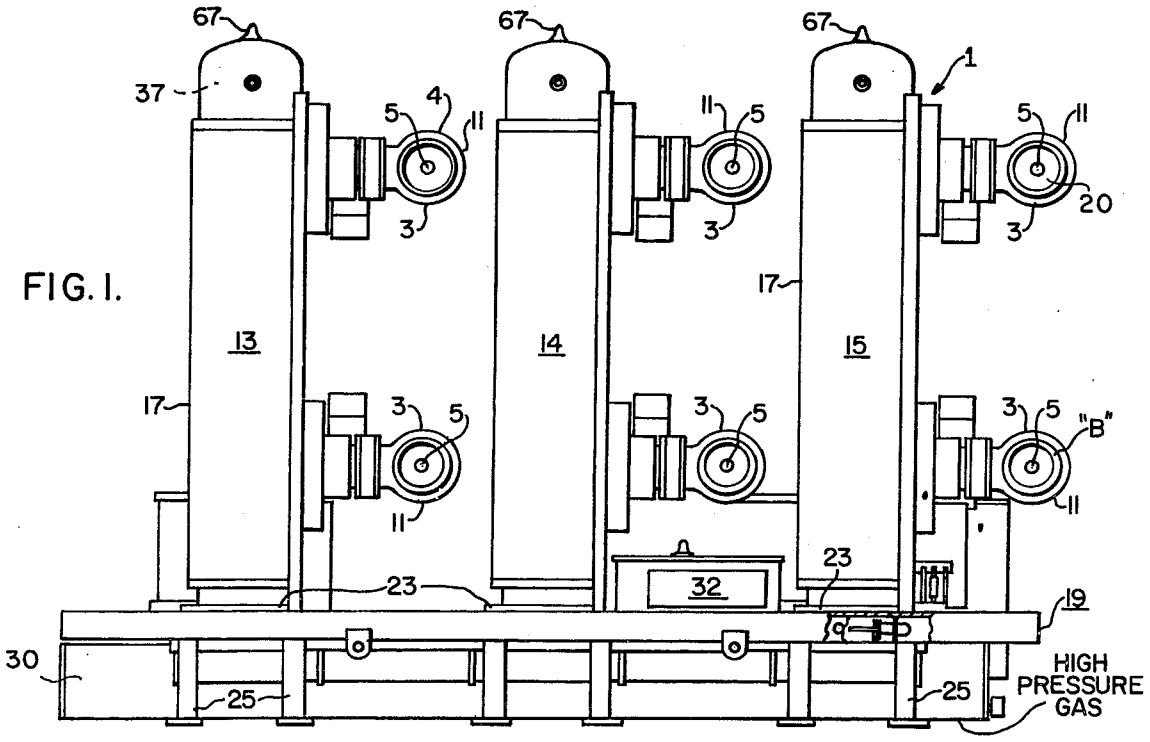
FIG. 1 illustrates a side-elevational view of a three-phase circuit breaker structure indicating the enclosing condition of the individual interiorly-disposed circuit-breaker modules.
Figure 4:
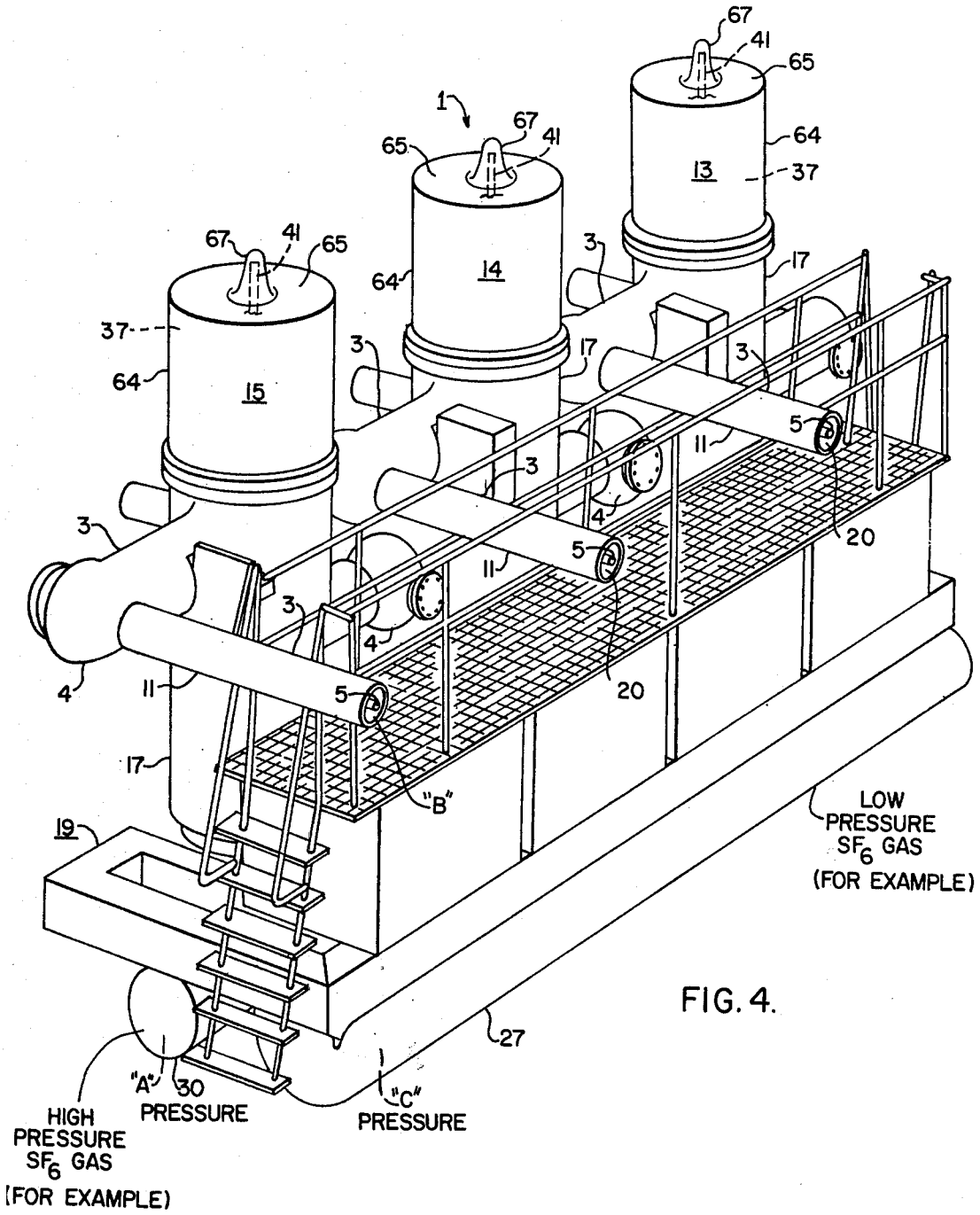
FIG. 4 is a perspective view again indicating the enclosed condition of the three circuit-breaker modules indicating the general environment of the invention.
Figure 5:
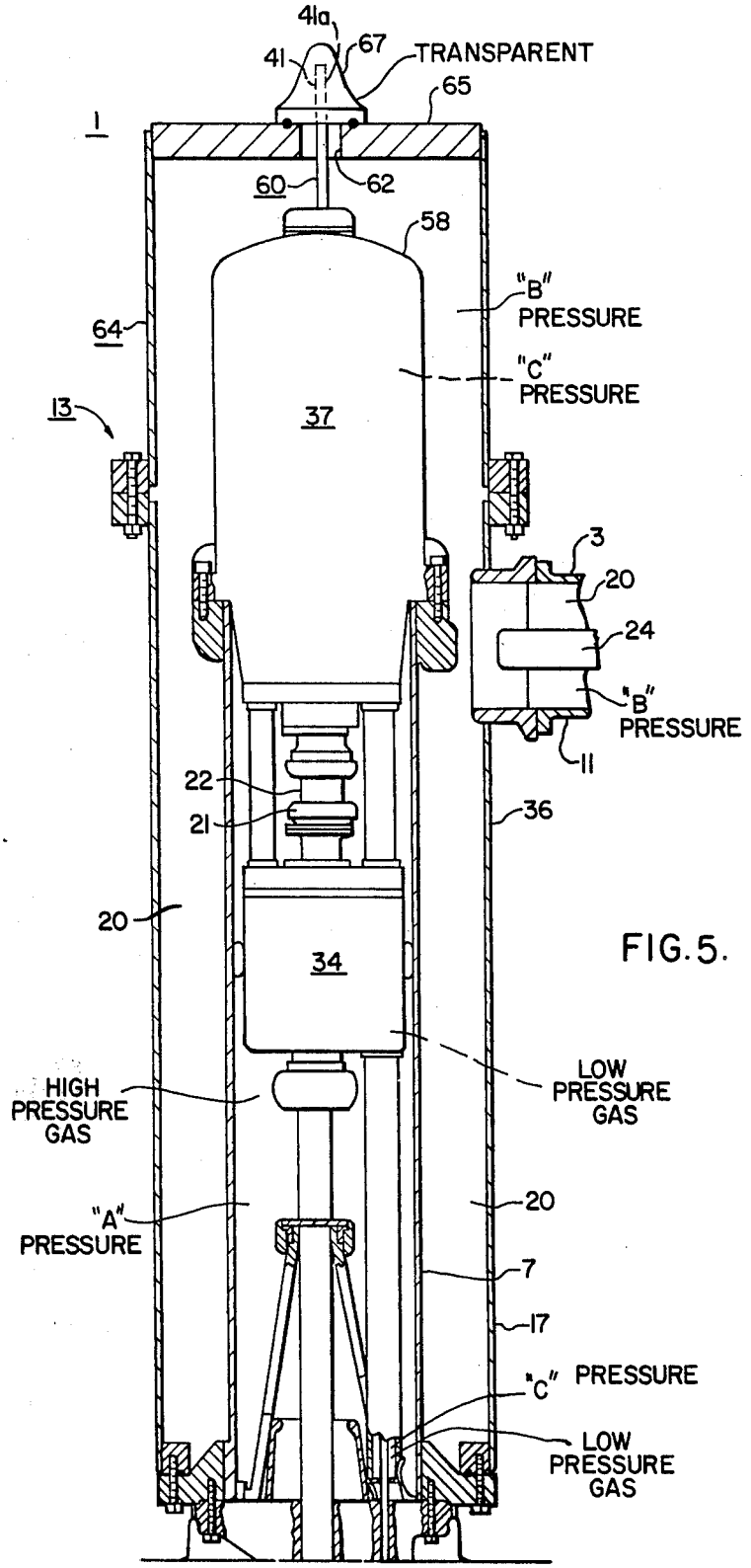
FIG. 5 is a vertical sectional view indicating the enclosed circuit-breaker module with the contact structure thereof closed, and the outer grounded pressurized casing structure broken away.

With reference to FIG. 1, it will be observed that there are provided three circuit-breaker assemblies, 13, 14 and 15, each including an outer casing structure 17, as more clearly illustrated in FIG. 5, enclosing separable contacts 21, 22 within an interiorly-disposed insulating casing 7, which are separable to an open-circuit position to establish arcing (not shown) and to effect circuit interruption. Reference may be made to the following United States patents for a detailed description of the individual circuit-interrupter assemblies, 13, 14 and 15; U.S. pat. No. 3,590,189, issued June 29, 1971, and also Kane et al. U.S. Pat. No. 3,596,028; Fischer et al. U.S. Pat. No. 3,639,713; Fischer et al. U.S. Pat. No. 3,624,329; and Reese et al. U.S. Pat. No. 3,665,133.

The circuit-breaker assemblies13, 14 or 15 are of high capacity and comprise three single phase units mounted vertically upon a lower support frame 19. These breaker-modules use sulfur-hexafluoride ($SF_6$) gas 20 for arc-extinction, insulation and operation. The three vertical single phase units 13, 14 and 15 are each mounted upon a base-plate 23. These base-plates 23 are supported by the boxed-in angle-type lower frame 19. This frame 19 is supported on one side by rectangular tubing-type legs 25. The low-pressure reservior tank 27 serves as a support for the opposite side. This feature is covered in the aforesaid U.S. Pat. application Ser. No. 527,931. Located longitudinally on one side of the breaker-assembly is a low-pressure gas-reservoir tank, 27 containing $SF_6$ gas 20. This reservoir tank 27 has a dual function. During normal breaker operation, it contains sulfur-hexafluoride gas 20 at a nominal pressure of 10 p.s.i.g., and also provides a main support for one side of the entire circuit-breaker installation 1. This reservoir 27 is an ASME coded vessel. It has a relief attached to it which is at 150 p.s.i.g.

The high-pressure reservoir tank 30 is located benath the phase-units, or circuit-breaker assemblies 13, 14, and 15, and provides an adequate high-pressure gas supply. The reservoir tank 30 contains a heater, and heating of each interruptor assembly 13, 14 or 15 is by convection through two feed pipes from this reservoir. This reservoir is ASME coded.

A compact weather-proof mechanism housing or cabinet 32 is located between two phase-units 14 and 15 as shown in FIG. 1. This housing 32 contains the operating mechanism and associated auxiliary switches, which provide closing and tripping contro, for the breaker 1. The interrupter columns 13, 14 or 15 consists of an interruptor-module 34 housed within the grounded tank 17, and a high-potential contact opeator 37 at the top of the column, as shown in FIg. 5. The interruptor module 34 is located in a high-pressure sulfur-hexafluoride gas 20 at a nominal 245 p.s.i.g., for example.

The interruptor module 34 is arranged with the contacts 21, 22 surrounded by high-pressure $SF_6$ gas 20 to give a minimum arcing time. On an opening operation, the high-potential operator 37 moves the movable interruptor contact 22 upwardly. As contact motion starts, the gas seal is broken between the contacts to permit high-pressure $SF_6$ gas, surrounding the contacts 21, 22, to start to flow radially-inwardly thriough the hollow contact assembly 22. Contact overlap perits the moving contact 22 to attain the desired opening velocity and gas flow before contact part. Upon contact part, the arc (not shown) is initially drawn between the stationary contact fingers 21 and the moving contact tip 22. Radial inward gas flow quickly transfers this arc to the arc tips resulting in a long arc, that is cooled and deionized by the flow of high-pressure $SF_6$ gas 20. Near the end of the moving contact travel, the blast-valve is actuated to close and to seal off the gas flow leaving the opened separated contacts 21, 22 in an atmosphere of high-pressure $SF_6$ gas 20. The total interrupting tine from trip-coil energization to arc interruption is two cycles, or less.

The breaker 1 uses high-pressure gas (245 p.s.i.g.) for primary insulation to ground, insulation across the open congtact 21, 22, pressure differential for gas flow to the 10 p.s.i.g. system during arc interruption, and energy for breaker operation. $SF_6$ gas 20 is used at an intermediate pressure of 45 p.s.i.g. in region B, for high dielectric strength in the area immediately inside the grounded tank assembly 17. There is no $SF_6$ circulation between this insulation system B and the other two pressure systems A and the low-pressure system C.

Sulfur-hexafluoride gas 20 in a pure state is inert and exhibits exceptional thermal stability. It has excellent arc-quenching properties. These characteristics, combined with its exceptionally good insulating properties, maket it an excellent medium for use in circuit-breakers 1.

When the circuit-breaker 1 operates, it discharges gas from the high-pressure side A to the low-pressure side C, and raises the pressure in the low-pressure side C. The low-pressure governor switch actuates at 16 p.s.i.g. and completes the circuit of the line-starter coil to close the line-starter, energizing the compressor motor, and pumping the gas from the low-pressure side C to the high-pressure side A. After normal low pressure is reached (10 p.s.i.g.), the low-pressure governor switch opens to deenergize the line-starter and to stop the compressor.

As mentioned briefly, during the opening operation of each interruptor module 13, 14 or 15, the upper movable contact 22 moves upwardly away from the lower stationary contact 21, as illustrated in FIG. 5 (showing only the closed position), establishing an arc therebetween (not shown), and effecting circuit interruption. Where desired, a movable isolator contact 24 (FIG. 5) may be moved to the open and closed-circuit positions by a suitable mechanism, constituting no part of the present invention, and the details of which may be obtained from a study of U.S. Pat. No. 3,700,840 — Wilson, and U.S. Pat. No. 3,694,592 — Kuhn.

Preferably a high-insulating gas 20, such as sulfur-hexafluoride ($SF_6$) gas, is utilized throughout the gas system, through the gas-insulated piping 3 and also within the circuit-interruptor modules 13, 14 and 15, as illustrated in FIG. 5.

Figure 6A:
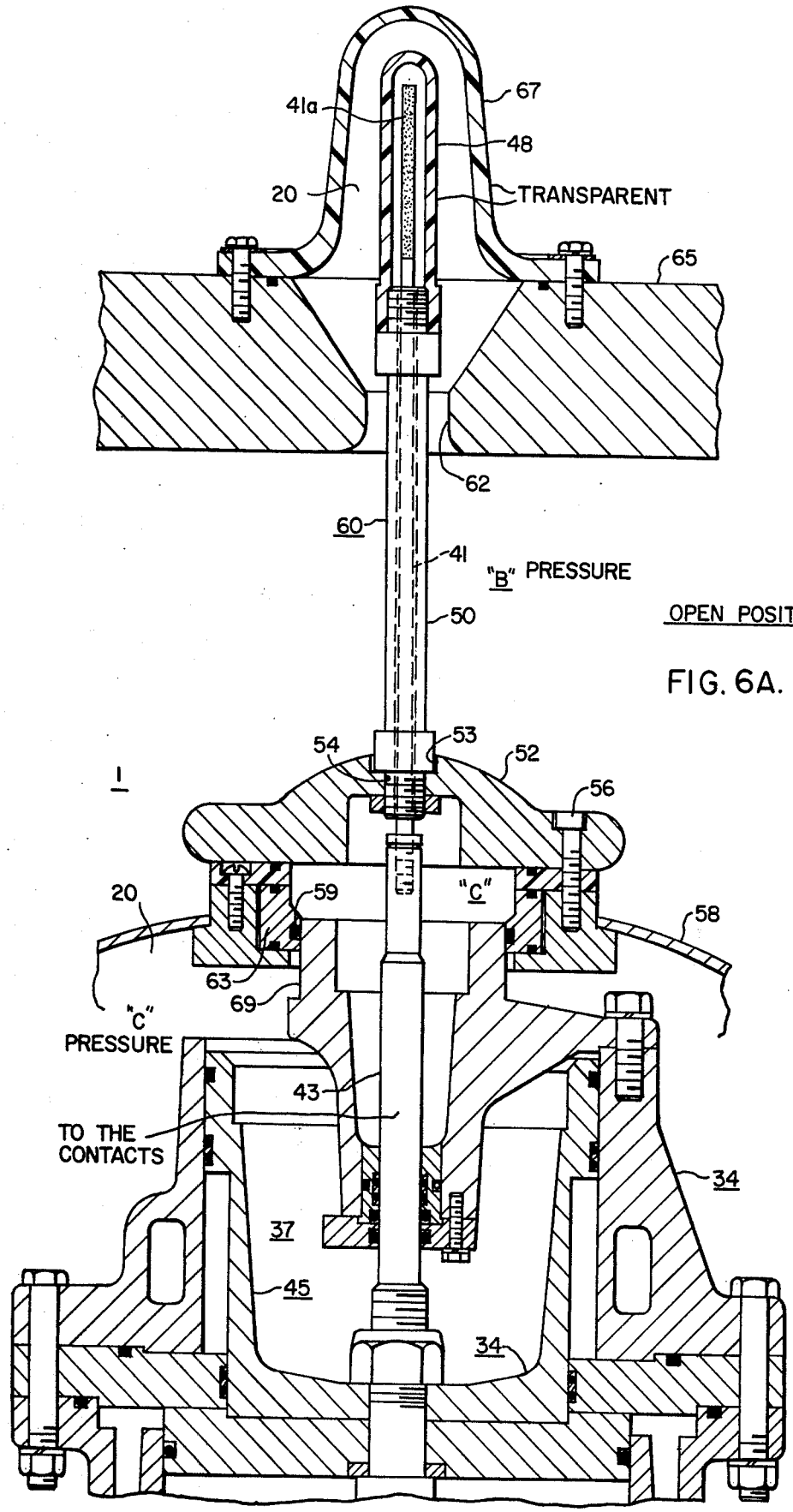
FIGS. 6 and 6A illustrates, to an enlarged scale, the moable indicator-rod structure in two positions, namely, the open-circuit position as shown in FIG. 6A, and the closed-circuit position, as shown in FIG. 6B.
Figure 14:
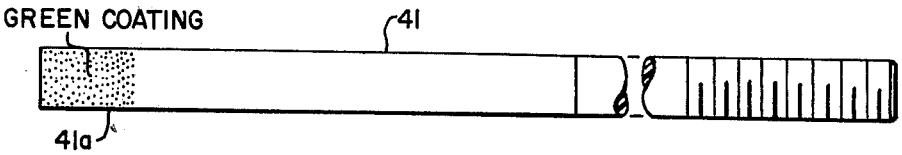
FIG. 14 is a side view of the indicator-rod itself.

It is desirable and essential to provide a safe visual indication of the open and closed-circuit positions of the movable contact structure 22. Since the movable contact structure 22 is entirely hidden by virtue of the two casing structures 7, 17 (FIG. 5), the present invention utilizes a longitudinally-movable indicator-rod 41 (FIG. 14) having a green coating (constituting a semaphore) on the surface of the extremity thereof, as indicated by the reference number 41a. It will be observed that the movable indicator-rod 41 is fixedly mechanically tied to the moving contact structure 22 by the upper extended piston-rod 43. The piston structure 45 (FIG. 6), associated with the high-potential operator 37, is set forth in detail in U.S. Pat. No. 3,639,713, to which reference may be had for a detailed description of the opening and closing operations of the movable contact structure 22. Generally, the movable contact structure 22 is actuated by a pair of spaced side insulated operating rods (not shown), secured to a yoke-bridging structure at the top, which is secured to the piston-rod 43. The piston-rod 43 is secured to a piston structure 45 set forth as reference numeral 8 in U.S. Pat. No. 3,639,713 issued Feb. 1, 1972. and assigned to the assignee of the present application. The continued extension of the piston-rod 43 results in the extremity portion 41 as set forth in FIG. 14 of the drawings.

Figure 6B:
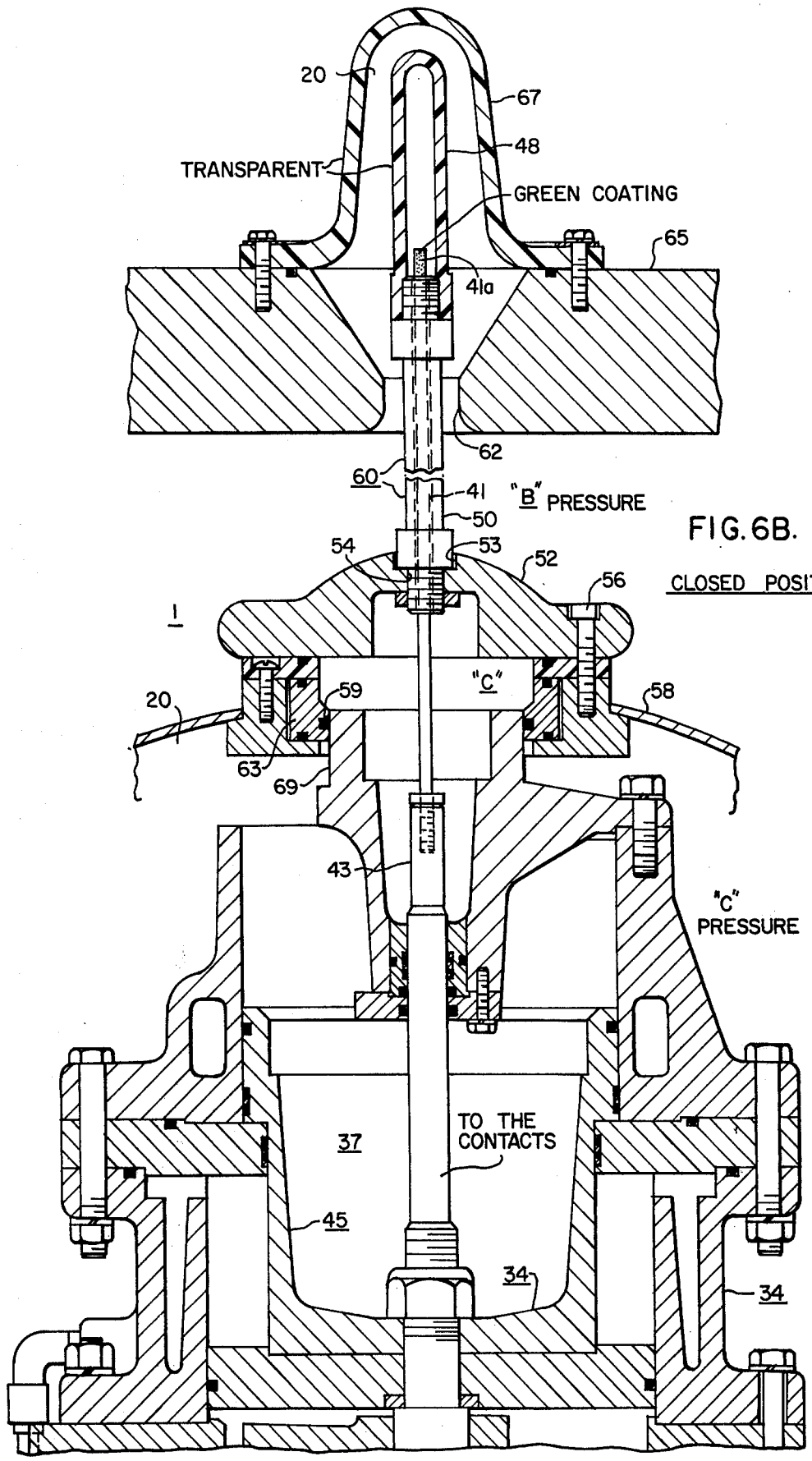
Figure 7:
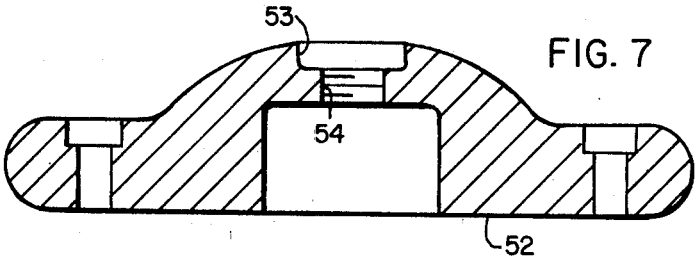
FIG. 7 illustrates a vertical-sectional view of the metallic dome-shield member of the upper portion of the circuit-breaker module.
Figure 8:
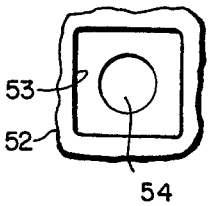
FIG. 8 is a fragmentary top plan view looking downwardly upon the metallic dome-shield member of FIG. 7.
Figure 15:
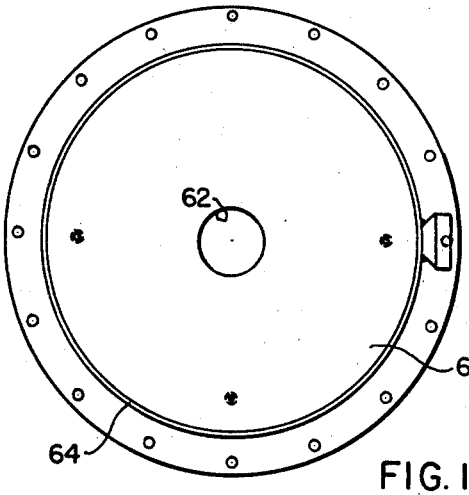
FIG. 15 is a top plan view of the circuit-breaker outer metalic housing cover.
Figure 16:
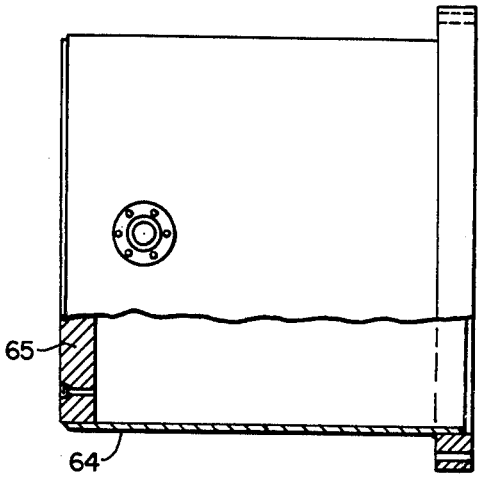
FIg. 16 is a side-elevational view, partly in section, of the metallic interruptor outer casing cover of FIG. 15; and, FIG. 17 illustrates the application of the substituted manually-operable hand-jack assembly enabling slow manual opening and closing movements of the circuit-breaker contacts during servicing operations.
Figure 10:
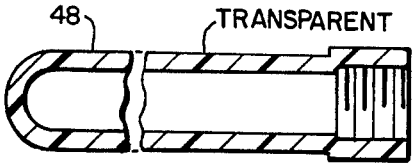
FIG. 10 is a sectional view of the transparent tubular cover for the indicator-rod.
Figure 11:
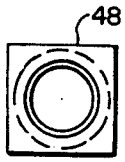
FIG. 11 is an end-elevational view of the tubular transparent cover of the indicator-rod assembly, as shown in FIG. 10.
Figure 12:
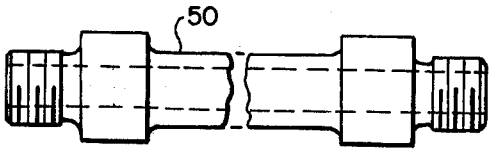
FIG. 12 is a side-elevational view of the resinous supporting casing tube for the indicator rod of FIG. 14.
Figure 13:
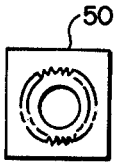
FIG. 13 is an end elevational view of the supporting casing tube of FIG. 12.

The opening travel of the movable contact structure 22 is approximately three inches, for example, and it results in the projection of the indicator-flag or green coating, 41a upwardly into the transparent tubular cover 48 (FIG. 10), which is threadedly secured to a tubular guide-assembly 50 (FIG. 12), the latter being threadedly secured in the metallic dome-shield 52, set forth in more detail in the FIGS. 7 and 8 of the drawings. It will be observed, with reference to FIGS. 7 and 8, that the metallic dome-shield 52 is provided with a recessed portion 53; and a tapped hole 54 is also provided through the upper portion of the metallic dome-shield 52. The dome-shield 52, as illustrated in FIG. 6, is secured by mounting bolts 56 to the upper metallic casing portion 58 of the circuit-interruptor module 34.

As illustrated in FIG. 6, the indicator-rod assembly 60 projects through an opening 62 provided in the outer metallic two-part casing top 64 having a top metallic plate 654, which, of course, is at ground potential.

The top plane 65 carries a transparent cover or cap 67 into which projects the indicator flag 41*a*.

It will be noted, in this connection, the the power-transmission system described herein is completely encased, or enclosed in the outer grounded metallic casing structure 17 fabricated of aluminum, for example. Thus, the indicator-rod 41 moves linearly, or longitudinally, through an outer fixed tubular structure 50, thereby preventing the intercommunication between the gas, disposed in the region C, which may be at a pressure-level of 10 psi gauge and the gas in region B at a pressure of 45 P.S.I.G., for example. On the other hand, the gas pressure within the region B, within the grounded casing structure 17 is as mentioned, at a different pressure-level say, for example, 45 lb psi gauge. It is, accordingly, therefore undesirable for the regions C and B to be interconnected, inasmuch as they both contain gas, such as sulfur-hexafluoride ($SF_6$) gas 20, for example, at different gas pressures. The stationary sealing member 69 mating with the stationary seal 63 and O-rings 59 prevents direct gas communication between regions C and B and permits the gas to be drained out of region B but maintained in regions A and C for test purposes.

From the foregoing description, it will be apparent that one externally of the three-phase circuit-breaker structure 1 may readily visually observe the open and closed-circuit positions of the movable contact structure 22 of the circuit-breaker through transparent cap 67, even though the contacts are encased in a surrounding grounded metallic gas-filled enclosure 17.

Figure 17:
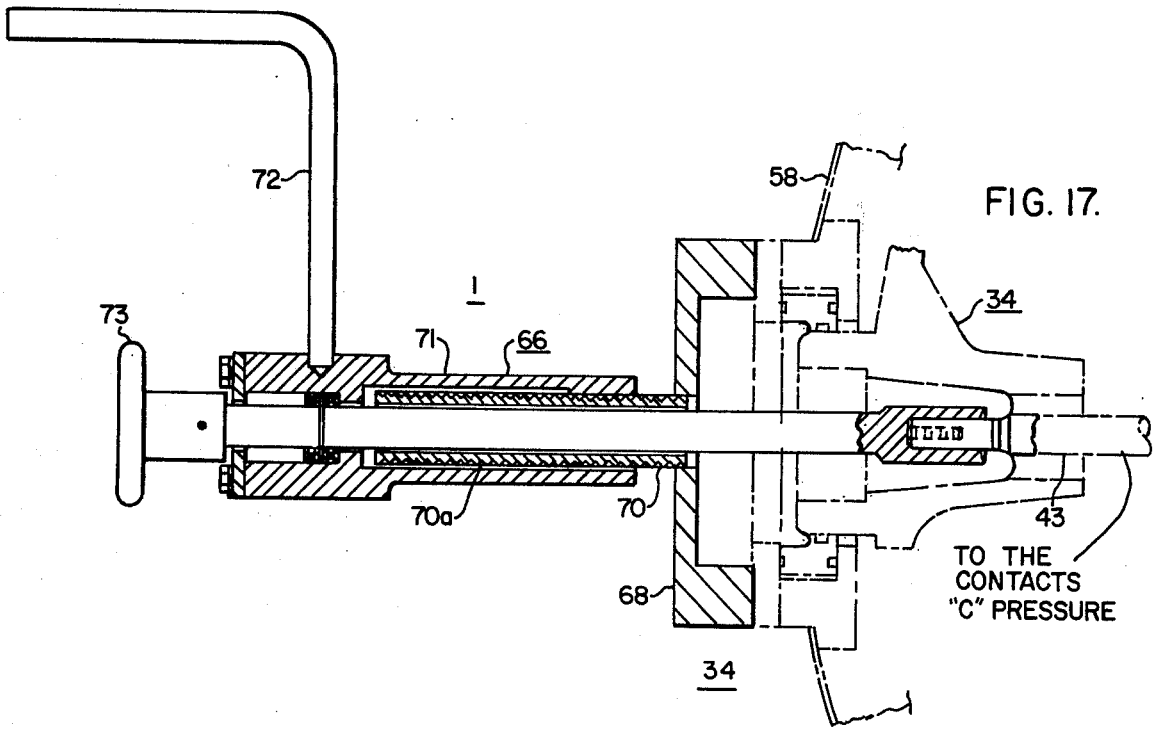
Figure 9:
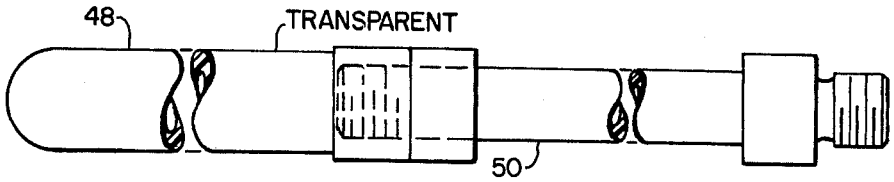
FIG. 9 is an enlarged side-elevational view of the indicator-rod casing structure.

For certain maintenance operations, it is desirable to substitute for the indicator-flag, or indicator-rod assembly 60, a hand-jack assembly 66, as illustrated more clearly in FIG. 17 of the drawings. Comparing FIG. 17 with FIG. 6A, it will be observed that only a slight modification is necessary, namely, the removal of the dome-shield 52 (FIG. 7), after prior removal of the top assembly 64 if the grounded casing 17 and the substitution therefor of a mounting-flange assembly 68, as illustrated in FIG. 17. A stationary guide tube-structure 70 is externally threaded, and rotating on the external threaded portion 70*a* of the stationary tube structure 70 is a threaded rotatable actuating sleeve 71 rotated by a manually-operable hand-crank 72, and effecting abutting engagement on rotation with an end extremity cap member 73 affixed to and movable with the piston-rod 43, and hence to the movable contact structure 22 of the circit-breaker 1. Thus, by manual rotation of the hand-crank 72, the outer sleeve-like actuating member 71 may be rotated upon the fixed tubular threaded guide portion 70, and thereby effect slow linear opening and closing travel of the piston-rod 43 and hence the movable contact 22.

From the foregoing description of the invention, it will be observed that there is provided a novel indicator-rod assembly 60, which is fixedly tied to the movable contact structure 22 for safe and dependable operation. The indicator-flag portion 41a (FIG. 14) is readily visible externally of the circuit-breaker structure 1, as indicated by the arrow D of FIG. 1.

For certain maintenance operations, and to perform certain testing procedures to obtain test data, as determining when the separable contacts 21, 22 in fact, close, slow manual closing travel of the movable contact structure 22 is desired. During this portion of the testing procedure, the manually-operable hand-jack assembly 66 of FIG. 17 is substituted for the indicator-flag assembly 60 of FIG. 6.

Although there has been illustrated and described a specific embodiment of the invention, it is to be clearly understood that the same as merely for the purpose of illustration, and that changes and modifications may readily be made therein by those skilled in the art, without departing from the spirit and scope of the invention.

What we claim is:

1. A power-transmission circuit-breaker installation comprising, in combination:

a. a gas-type enclosed circuit-breaker module (34);

b. said enclosed circuit-breaker module (34) having a movable contact (22) cooperable with a stationary contact (21) to establish an arc and open the connected circuit;

c. an indicator-rod (41) responsive to movement of the movable contact (22) of the enclosed circuit-breaker module (34) in its opening and closing movements;

d. a semaphore (41*a*) secured to and movable with the indicator-rod (41) to indicate visibly the open and closed-circuit positions of the circuit-breaker module (34);

e. a metallic grounded housing (17) encasing the circuit-breaker module (34) and having a transparent cap-portion (67);

f. an insulating dielectric gas (20) disposed within said metallic grounded housing (64) in region "B" for dielectric insulation between the high-potential parts of the circuit-breaker module (34) and the outer surrounding metallic grounded housing (64);

g. said indicator-rod (41) projecting at times within said transparent cap-portion (67);

h. said circuit-breaker module containing gas at a different high-pressure level A than the pressure-level of the gas within said housing B;

i. a generally tubular insulating housing (50) surrounding the indicator-rod (41) and gas-sealed to the circuit-breaker module (34), at a relatively-low-gas pressure level C which is lower than gas pressure level A, so that any gas from the circuit-breaker module at relatively low-gas pressure level C which creeps axially along the indicator-rod (41) during its linear longitudinal opening and closing motion will not be allowed to enter the gas-region B within the outer metallic grounded housing (17) encasing the circuit breaker module; and, j. said indicator-rod (41) movable longitudinally at all times within said tubular gas-sealed insulating housing (50).

2. The combination according to claim 1, wherein the indicator-rod (41) is directly connected to an operating rod (43) of the circuit-breaker module (34), and an operating piston structure (45) is attached to and causes the movement of said operating rod (43).

3. The combination according to claim 2, wherein two different pressures A and C act upon the piston structure (45) for effecting the opening and closing movements of the piston structure (45), and thereby correspondingly effect opening and closing motion of the movable contact structure (22) of the circuit-breaker module (34) and also opening and closing movements of the indicator-rod (41).

4. The combination according to the claim 2, wherein the piston structure (45) is a differential piston having unequal opening and closing surface areas.

5. The combination according to claim 1, wherein the indicator-rod assembly (60) may be removed from the end of the circuit-breaker module, (34) and a manually-operable hand-jack (66) may be substituted therefor, and will cause relatively slow opening and closing movements of the operating-rod (43) and hence the movable contact (22) of the circuit-breaker module (34).

6. The combination according to claim 4, wherein the outer metallic grounded housing (17) has a removable cap-portion (64) which when removed permits substitution of the hand-jack assembly (66) for the indicator-rod assembly (60).

7. In combination, an enclosed circuit-breaker module (34) having gas disposed therein, piston structure (45) for effecting the actuation of the movable contact (22) of the circuit-breaker including a rod-extension (41) projecting externally of the circuit-breaker module (34), a tubular casing (50) closely surrounding said rod (41) and preventing leakage of gas from the circuit-breaker module (34) lengthwise along the extension rod (41), said tubular casing having a transparent portion (48) at one end thereof, said indicator-rod (41) having a semaphore (41*a*) attached adjacent one end thereof so as to project through the transparent portion (48) of the tubular casing (50) and an outer-disposed metallic grounded casing structure (17) have a matching mating transparent viewing cap 67 matching said transparent portion 48.

8. The combination according to claim 7, wherein the indicator-rod (41) and the tubular casing (50) project into a region B having a pass pressure at a different pressure-level than the gas disposed within the circuit-breaker module (34) region A and C.

9. In combination, a metallic grounded housing (17) having a removable metallic cap-portion (64) with a transparent cap (67) associated therewith, a circuit-breaker module (34) disposed within said two-part metallic grounded housing-structure (17, 64) having a movable contact (22) separable from a stationary contact (21) to establish an arc and open the connected circuit an indicator-rod assembly (60) including a movable indicator-rod (41) having a semaphore (41*a*) affixed thereto movable longitudinally within an outer stationary tubular insulating rod-portion (50) having a transparent end (48); the transparent end (48) of the tubular stationary housing portion (50) projecting into the transparent cap (67) associated with the cap (64) of the outer two-part metallic grounded housing-structure (17, 64); and gas (20) disposed at three pressure-levels one at one pressure-level B within the two-part outer metallic grounded housing-structure (17, 64), and other gas at a different pressure-level A and C disposed within the circuit-breaker module (34).

10. A power-transmission circuit-breaker installation including, in combination, an outer metallic grounded housing portion (17) and an inner-disposed circuit-breaker module (34) having a movable contact (22) cooperable with a stationary contact (21), an operating rod (43) for effecting the opening and closing motions of the movable contact, said operating rod (43) having an insulating indicator-rod extension (41) projecting externally out of the circuit-breaker module (34), a tubular insulating casing (50) sealed to one end of the circuit-breaker module (34) and encasing the indicator-rod (41), a semaphore (41*a*) secured to one end of the indicator rod (41), the tubular insulating casing (50) having a transparent portion (48) adjacent one end thereof, the outer metallic grounded housing (17) having a transparent cap (67) associated therewith into which projects the transparent portion (48) of the stationary tubular casing (50), whereby the indicator-rod (41) projects the semaphore (41*a*) attached therewith, at times, into the transparent portion (48) of the tubular insulating casing (50), which additionally is visible within the outer transparent cap-portion (67) associated with the outer metallic grounded housing (17) for visible indication of the open and closed-circuit positions of the movable contact structure (22) of the circuit-breaker module (34).

11. The combination according to claim 10, wherein the indicator-rod (41) and surrounding encasing tubular portion (50) are removable to permit the substitution therefor of a hand-jack (66) which permits the slow manual opening and closing movement of the movable contact structure (22) of the circuit-breaker module (34).

12. In combination, a circuit-breaker module (34) having a piston structure (45) disposed adjacent one end thereof for causing the actuation of the movable contact (22) of the circuit-breaker module (34), a removable dome-shield portion (52) removable secured to one end of the circuit-breaker module (34) adjacent the piston structure (45), said dome-shield (52) carrying therewith a tubular insulating member (50) having a transparent portion (48) disposed adjacent one end thereof, an indicator-rod (41) attached to the piston structure (45) and projecting interiorly within the outer surrounding tubular insulating portion (50), and means for removing the dome-shield (52) together with the tubular insulating casing (50) and also the indicator-rod assembly (41) to permit the substitution therefor of a hand-jack (66) including a threaded tube (71) threaded over a stationary threaded guide tube (70) and rotatable by a crank-lever (72) for slow open and closing movements of the movable contact structure (22) of the circuit-breaker module (34).

* * * * *